US006568865B1

(12) United States Patent
Fujioka et al.

(10) Patent No.: US 6,568,865 B1
(45) Date of Patent: May 27, 2003

(54) EJECTED PAPER RECEIVING UNIT FOR LARGE PRINTER AND LARGE PRINTER EQUIPPED WITH THE SAME

(75) Inventors: Satoshi Fujioka, Nagano (JP); Hiroshi Asawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 104 days.

(21) Appl. No.: 09/697,055

(22) Filed: Oct. 27, 2000

(30) Foreign Application Priority Data

Oct. 29, 1999 (JP) ..... 11-309141

(51) Int. Cl.[7] ..... B41J 2/06

(52) U.S. Cl. ..... 400/647.1; 400/625; 271/207; 271/213; 347/104

(58) Field of Search ..... 400/622, 624, 400/625, 633.1, 645, 647.1; 399/384, 397; 347/104; 271/207, 213

(56) References Cited

U.S. PATENT DOCUMENTS 5,014,976 A * 5/1991 Muck et al. ..... 271/220
5,081,487 A * 1/1992 Hoyer et al. ..... 271/213
5,241,353 A * 8/1993 Maeshima et al. ..... 271/207
5,342,133 A * 8/1994 Canfield ..... 226/172
5,486,911 A * 1/1996 Rubscha et al. ..... 271/213
5,573,337 A * 11/1996 Yasuoka ..... 400/605
5,586,758 A * 12/1996 Kimura et al. ..... 271/186
5,810,494 A * 9/1998 Menard et al. ..... 346/136
6,357,861 B1 * 3/2002 Katsumi ..... 347/55

FOREIGN PATENT DOCUMENTS

| | | |
|---|---|---|
| EP | 0 579 416 A2 | 1/1994 |
| JP | 11 043254 | 2/1999 |
| JP | 2000 159412 | 6/2000 |

* cited by examiner

*Primary Examiner*—Andrew H. Hirshfeld
*Assistant Examiner*—Kevin D. Williams
(74) *Attorney, Agent, or Firm*—Sughrue Mion, PLLC

(57) ABSTRACT

A fulcrum shaft 61 and a recessed sheet member 64, which together constitute an ejected paper receiving unit that is rotatable force forward and backward within a range extending from a front receiving position and a rear receiving position. When an operator rotates the ejected paper receiving unit 6 forward and sets it at the front receiving position, a print sheet that is ejected by a paper ejection unit 4 is accepted while sliding forward along the sheet member 64. And when the operator rotates the ejected paper receiving unit 6 to the rear and sets it at the rear receiving position, a print sheet ejected by the paper ejection unit 4 is accepted while sliding to the rear along the sheet member 64.

14 Claims, 8 Drawing Sheets

EJECTED PAPER RECEIVING UNIT FOR LARGE PRINTER AND LARGE PRINTER EQUIPPED WITH THE SAME

BACKGROUND OF THE INVENTION

The present invention relates to an ejected paper receiving unit that accepts print sheets ejected by a large printer capable of printing sheets up to size A1 or B1, and a large printer equipped with such an ejected paper receiving unit.

Generally, a large printer is so designed that print sheets are ejected obliquely downward by a paper ejection unit and are accepted by an ejected paper receiving unit that is located below the paper ejection unit.

An ejected paper receiving unit can also accept relatively short print sheets, such as cut-sheets or sheets cut from paper rolls, that a large printer discharges to the rear, and can also accept relatively long print sheets that a large printer discharges to the front. Thus, in accordance with the length of a print sheet, the configuration of an ejected paper receiving unit can be altered so it can receive paper while facing to the rear or so that it can receive paper while facing the front.

For a related ejected paper receiving unit a plurality of operations are required to accept print sheets while it is positioned to the front. Specifically, in order to assemble an ejected paper stacker so that it can accept print sheets ejected to the front, an operator must change an ejected paper switching level so that the receiving direction is to the front, and must pull forward two stacking cloth fixing levers that are stored at opposite ends of the ejected paper receiving unit. In addition, an operator must pull the stacking cloth forward and attach its front end to the front ends of the stacking cloth fixing levers.

The operation of a related ejected paper receiving unit requires the performance of many procedures and much time. For instance, when a configuration whereby a print sheet is accepted to the front is changed to a configuration whereby a print sheet is accepted to the rear, or when printing is completed and the ejected paper stacking device must be disassembled and stored, an operation that is the inversion of the one performed during the assembly process, a large number of procedures must be performed, and an extended period of time is required.

SUMMARY OF THE INVENTION

To resolve the above problems, it is one objective of the present invention to perform a simple and short operation when switching from an ejected paper receiving unit configuration whereby print sheets are received to the front to a configuration whereby print sheets are received to the rear.

In order to achieve the above object, according to the present invention, there is provided an unit for receiving paper ejected from a large printer which is provided with a print feeding unit for feeding the print paper from upward, a printing unit for conveying the print paper while printing thereon, and a paper ejection unit for ejecting the print paper obliquely downward after completion of the printing, comprising:

a fulcrum shaft disposed below the paper ejection unit so as to extend in a widthwise direction of the print paper;

a receiver coupled with the fulcrum shaft so as to be pivotable about the fulcrum shaft, and including a receiving member for accepting the ejected print paper, which is provided between a front end and a rear end of the receiver so as to be recessed downward, the receiver having:

a first position for accepting the ejected print paper at a front side of the printer, in which the receiver is pivoted such that the front end thereof is positioned lower than the rear end thereof; and a second position for accepting the ejected print paper at a rear side of the printer, in which the receiver is pivoted such that the rear end thereof is positioned lower than the front end thereof, wherein a line extended straight from the paper ejection unit along a paper ejecting direction intersects the receiving member when the receiver is in the first portion and the second position.

In this configuration, a sheet is fed from the paper feeding unit, is printed by the printing unit, is ejected obliquely downward by the paper ejection unit, and is accepted by the ejected paper receiving unit.

The ejected paper is smoothly accepted along the receiving member which is recessed downward.

Whether the ejected print paper is accepted at the front side or the rear side of the printer is easily altered by pivoting the receiver, which is very simple operation.

Furthermore, since the line extended straight from the paper ejection unit along a paper ejecting direction intersects the receiving member when the receiver is in the first portion and the second position, the ejected print paper can be surely accepted by the receiving member.

Preferably, the rear end of the third portion of the receiver is shaped so as to stand upright when the receiver is in the second position.

Generally, print paper received to the rear are relatively short, such as cut-sheets or sheets cut from rolls. Such print sheets are ejected by the paper ejection unit, freely drop to the paper receiving unit, and smoothly slide along the recessed shape formed by the receiving member. Thus, depending on the printing speed, when ejected the print paper may overshoot the rear end of the ejected paper receiving unit and fall to the floor.

In the above configuration, since the rear end of the receiver stands upright when the receiver is positioned at the rear receiving position (the second position), the rear end serves as a stopper. Therefore, the print paper received at the rear are surely halted and held at the rear of the paper receiving unit.

Preferably, the receiving member is attached to the front end of the receiver such that the attached portion is hidden from a side on which the ejected print paper passes, when the receiver is in the first position.

Generally, the print paper accepted to the front are relatively long. And even when the leading end of such a long print sheet has been received by the ejected paper receiving unit, the middle or the rear portion will still be being printed by the printing unit of a large printer, and the leading end may pass the front end of the receiving member and drop to the floor. In this case, if the leading end of the print sheet can not smoothly pass the front end of the receiver and is caught there, the rear portion of the sheet will be deflected or folded over, so that a crease may be formed in the print sheet or so that portions of the printing face may contact each other and be smudged.

In the above configuration, since the attached portion is hidden from the side on which the ejected print paper passes, the front end of the receiver is substantially linear or smoothly curved. Thus, the print sheets can be smoothly moved without being caught at the front of the receiver, and as a result, the related problem can be avoided.

Preferably, the receiver includes:

a pair of pivotable members coupled with both ends of the fulcrum shaft;

a pair of first lever members extending forward from the pivotable members to constitute the front end of the receiver;

a pair of second lever members extending backward from the pivotable members to constitute the rear end of the receiver;

a first connecting shaft extending substantially parallel with the fulcrum shaft to connect the first lever members; and a second connecting shaft extending substantially parallel with the fulcrum shaft to connect the second lever members.

In the configuration, the lever member pairs on the side ends can be interlocked and rotated together, and the strength of the lever members for resisting twisting can be increased.

Preferably, the paper receiving unit further comprises an adjuster for adjusting a force required to pivot the receiver.

In the configuration, adjusting the appropriate rotatable force with the adjuster, unexpected switching of the ejected paper receiving position can be prevented, and the switching from and to the front receiving position and the rear receiving position can be smoothly performed.

When the ejected paper receiving unit is moved to the front receiving position or to the rear receiving position, since the adjuster can be used to increase the rotatable force, the receiver can be fixed at the pertinent paper receiving position. While during the changing of the ejected paper receiving position, since the adjuster can be used to reduce the rotatable force, only a relatively small force is required to move the receiver.

Preferably, the paper receiving unit further comprises a pair of legs for supporting both side end portions of the printer, which is connected by the fulcrum shaft.

In the configuration, since the fulcrum shaft also serves as the coupling shaft that is provided between the legs, complexity in the construction of the large printer due to the provision of the paper receiving unit can be avoided, as can an increase in manufacturing costs due to the need for additional parts.

Preferably, the second position of the receiver is configured such that the line extended straight from the paper ejection unit along a paper ejecting direction intersects the receiving member at an angle allowing the print paper ejected and slid along the receiving member to pass through the intersection.

If the leading end of the ejected print paper is brought into contact with the receiving member and is caught and retained there, the transportation resistance of the printing unit is increased. Thus, either the print paper can not be smoothly transported by the printing unit, or at the printing unit the print sheet will be deflected and make contact with the print head and cause the print quality to be deteriorated. Further, the leading end of the print paper may be folded over. Such a problem especially tends to occur when a relatively short print paper is conveyed to the rear receiving position.

In the above configuration, since the print paper can be smoothly moved without being caught and held by the receiving member, the printing unit can smoothly convey the print paper, and the related problem can be avoided.

According to the present invention, there is also provided a large printer comprising:

a print feeding unit for feeding the print paper from upward;

a printing unit for conveying the print paper while printing thereon;

a paper ejection unit for ejecting the print paper obliquely downward after completion of the printing; and the paper receiving unit as described the above.

In the configuration, the same effects can be acquired as are attained by the paper receiving unit as described the above.

DETAILED DESCRIPTION OF THE PREFERRED EMBODIMENTS

Figure 1:
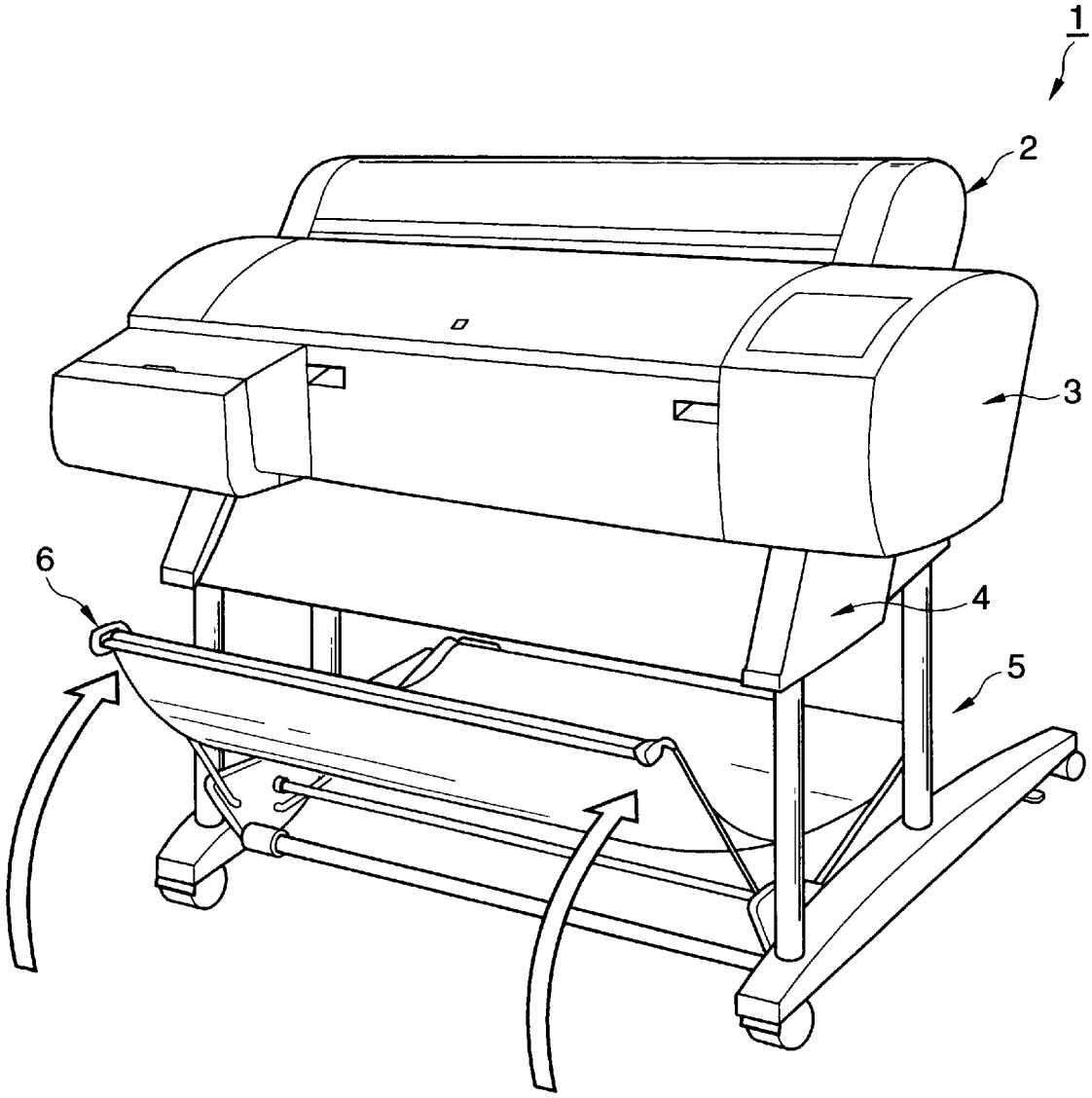
FIG. 1 is a perspective view of a large printer equipped with an ejected paper receiving unit according to one embodiment of the present invention, showing a configuration in which print sheets are accepted to the front.
Figure 2:
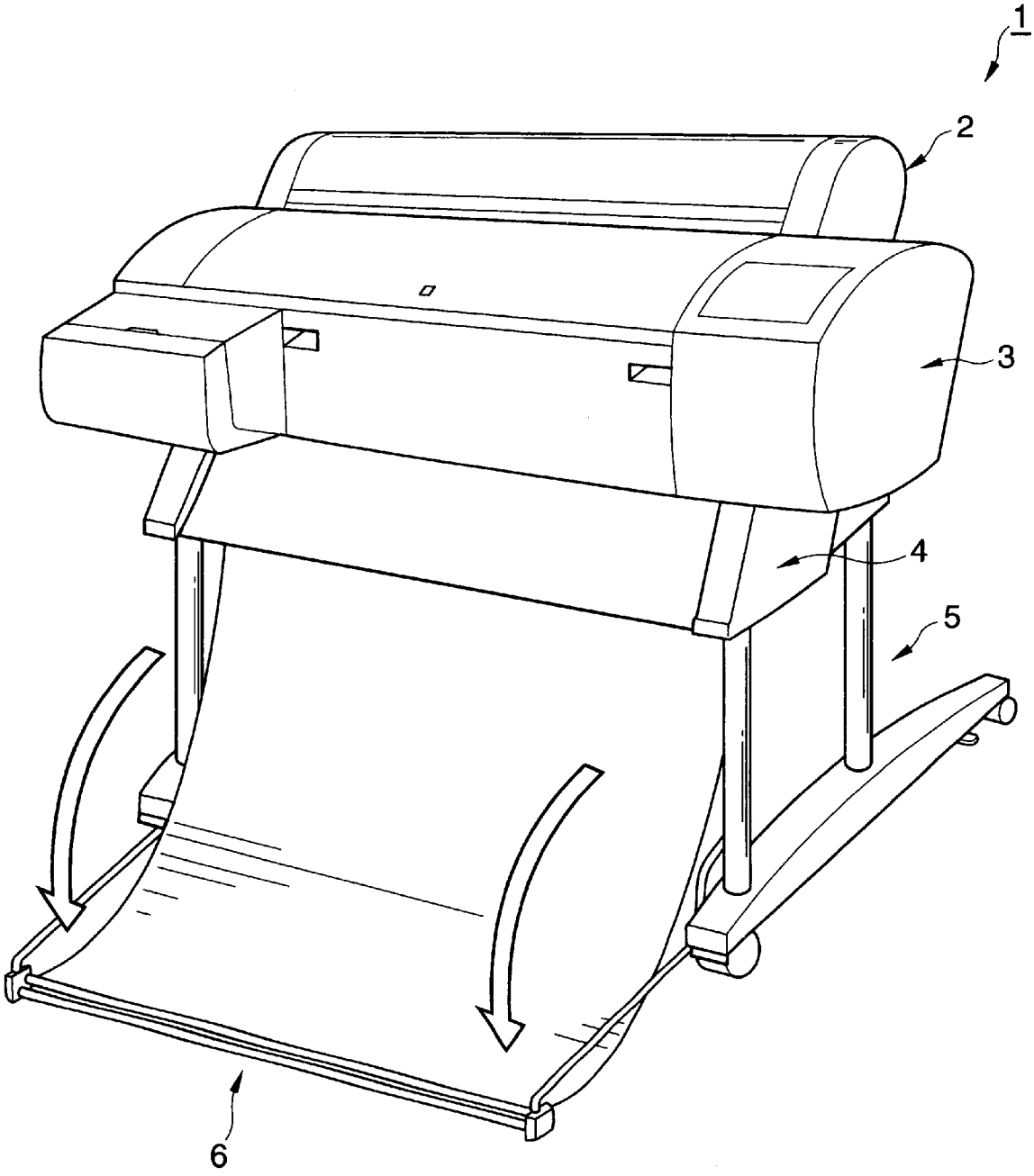
FIG. 2 is a perspective view of the large printer, showing a configuration in which print sheets are accepted to the rear.
Figure 3:
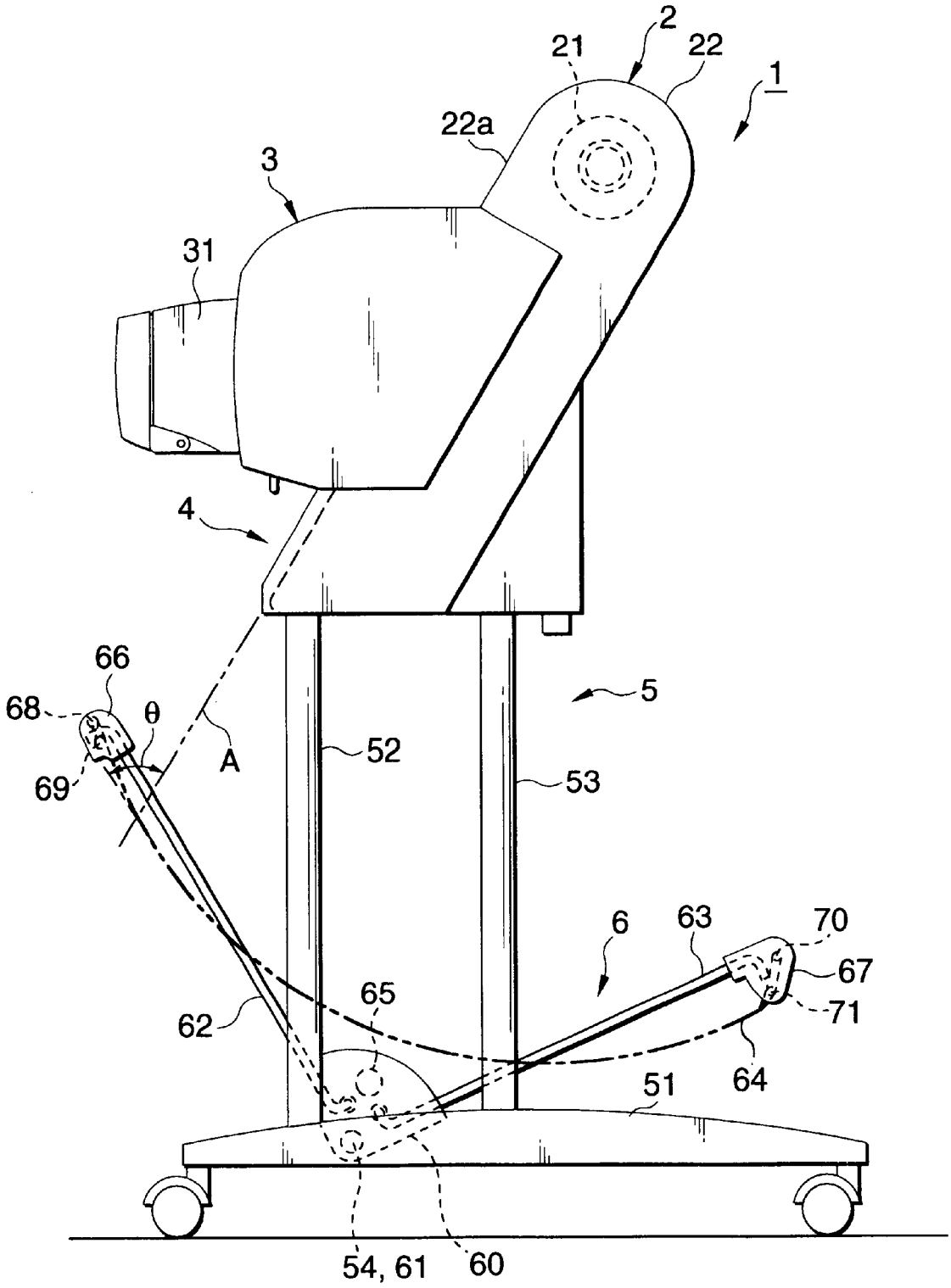
FIG. 3 is a side view of the large printer, showing the configuration in which print sheets are accepted to the rear.
Figure 4:
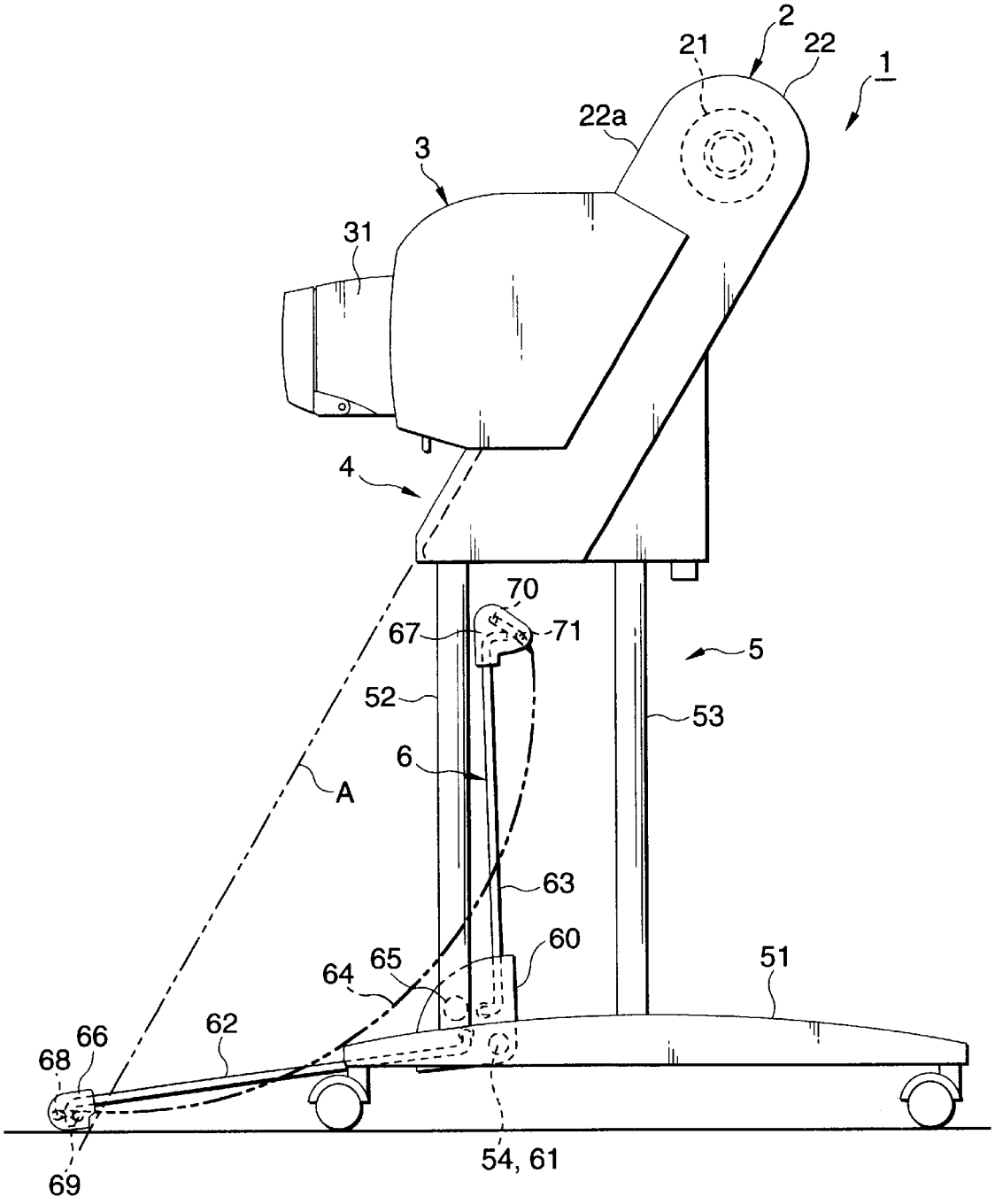
FIG. 4 is a side view of the large printer, showing the configuration in which print sheets are accepted to the front.
Figure 5:
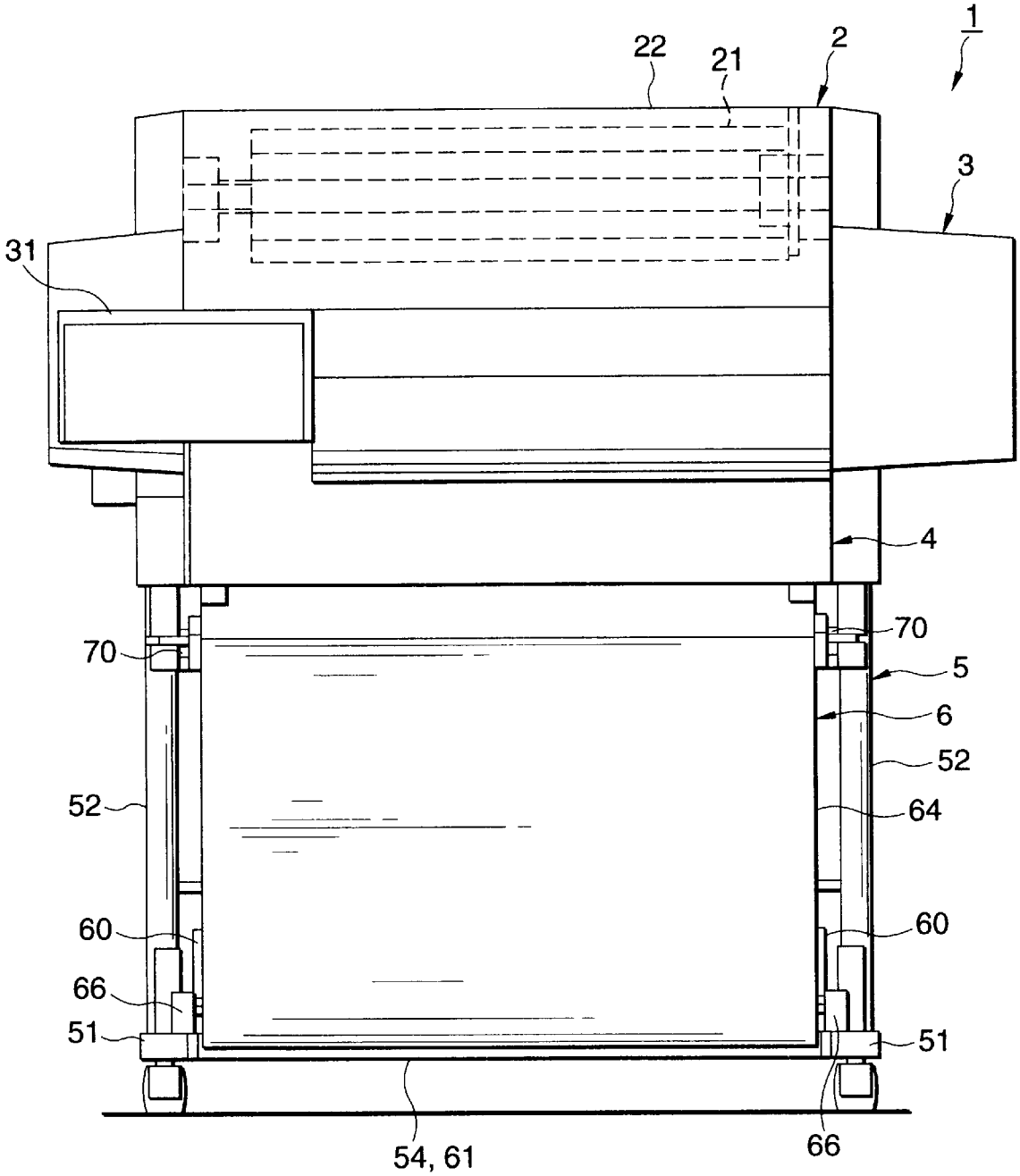
FIG. 5 is a front view of the large printer showing the configuration in which print sheets are accepted to the front.

FIGS. 1 and 2 are perspective views of a large printer that includes an ejected paper receiving unit according to one embodiment of the invention. FIGS. 3 and 4 are side views of the large printer, and FIG. 5 is a front view. In FIGS. 1 and 3, the ejected paper receiving unit is set at the position for accepting a sheet ejected toward the rear (hereinafter referred to as a "rear receiving position"). In FIGS. 2, 4 and 5, the ejected paper receiving unit is set at the position for accepting a sheet ejected toward the front (hereinafter referred to as a "front receiving position").

A large printer 1 can print sheets up to those having a widthwise size of A1 or B1, and comprises a paper feeding unit 2, a printing unit 3 and a paper ejection unit, which together constitute the main printer body, a leg unit 5, and an ejected paper receiving unit 6.

The paper feeding unit 2 projects upward at the rear of the large printer 1. Roll paper (for print sheets) 21 is loaded inside the paper feeding unit 2, and a paper roll cover 22, for covering the roll paper 21, is attached to the outer face of the paper feeding unit 2 and can be freely opened and closed. A front inclined face 22*a* of the roll cover 22 is also used as a guide plate for guiding a cut-sheet (a print sheet). A print sheet (the roll paper 21 or a cut-sheet that is positioned on the front inclined face 22*a*) is conveyed to the printing unit 3.

The printing unit 3 includes a carriage, a print head mounted on the carriage, and a paper feed roller (none of which are shown) for feeding a print sheet in the sub-scanning direction. The printing unit 3 prints the sheet that is fed from the paper feeding unit 2, while conveying it in the sub-scanning direction. Attached to the front face of the printing unit 3 are an ink cartridge case 31 and an ink cartridge (neither of which is shown) in which ink is retained and is supplied to the print head mounted in the ink cartridge case 31.

After being printed by the printing unit 3, a print sheet is ejected, through the paper ejection unit 4, obliquely downward toward the front of the large printer 1 (hereinafter referred to as the "paper ejecting direction"). Formed in the inclined face of the paper ejection unit 4 is a suction port (not shown) that is used to draw the print sheet down and hold it so it does not rise and lose contact with the inclined face.

A cutter is provided between the printing unit 3 and the paper ejection unit 4 to cut a print sheet (used especially for the roll paper 21). A print sheet that has been printed is cut by the cutter to provide a desired length that is thereafter ejected.

The leg unit 5 includes a pair of parallel mounted leg bases 51, paired front legs 52 and paired rear legs 53, all of which are mounted in parallel, and a coupling shaft 54 that connects the leg bases 51.

The ejected paper receiving unit 6, which will be described later, is mounted between the leg bases 51. Therefore, the interval between the base legs 51 is so set that the ejected paper receiving unit 6 can satisfactorily accept a print sheet having the maximum width (e.g., a B1 size sheet) that the large printer 1 can print.

The upper ends of the front legs 52 and the rear legs 53 are attached to the bottom of the printer main body (the assembly consisting of the paper feeding unit 2, the printing unit 3 and the paper ejection unit 4), and the lower ends are attached to the leg bases 51, so that the printer main body is supported by the legs 52 and 53 at a height whereat an operator can easily use the printer while standing.

The ejected paper receiving unit 6 includes a fulcrum shaft 61 that also serves as the coupling shaft 53, and a recessed sheet member (e.g., cloth) 64 that serves as an ejected paper receiving unit. At the fulcrum shaft 61, the ejected paper receiving unit 6 is pivotable to the front and the rear within a range spanning the distance between the front receiving position and the rear receiving position.

When an operator rotates the ejected paper receiving unit 6 to the front, as is indicated by the arrows in FIG. 2, and places it in the front receiving position, as is shown in FIGS. 2 and 4, a print sheet ejected by the paper ejection unit 4 is accepted and is shifted forward along the sheet member 64. Then, when the operator rotates the ejected paper receiving unit 6 to the rear, as is indicated by the arrows in FIG. 1, and places it in the rear receiving position, as is shown in FIGS. 1 and 3, a print sheet ejected by the paper ejection unit 4 is accepted and is shifted to the rear along the sheet member 64.

The front end of the sheet member 64 is attached to rod members (e.g., metal rods) 68 and 69, and the rear end is attached to rod members (e.g., metal rods) 70 and 71, so that the portion between the two ends is naturally recessed by gravity. Further, the width of the sheet member 64 is equal to or greater than the maximum width of a print sheet (e.g., the B1 size), so that the print sheet can be satisfactorily accepted.

Figure 8:
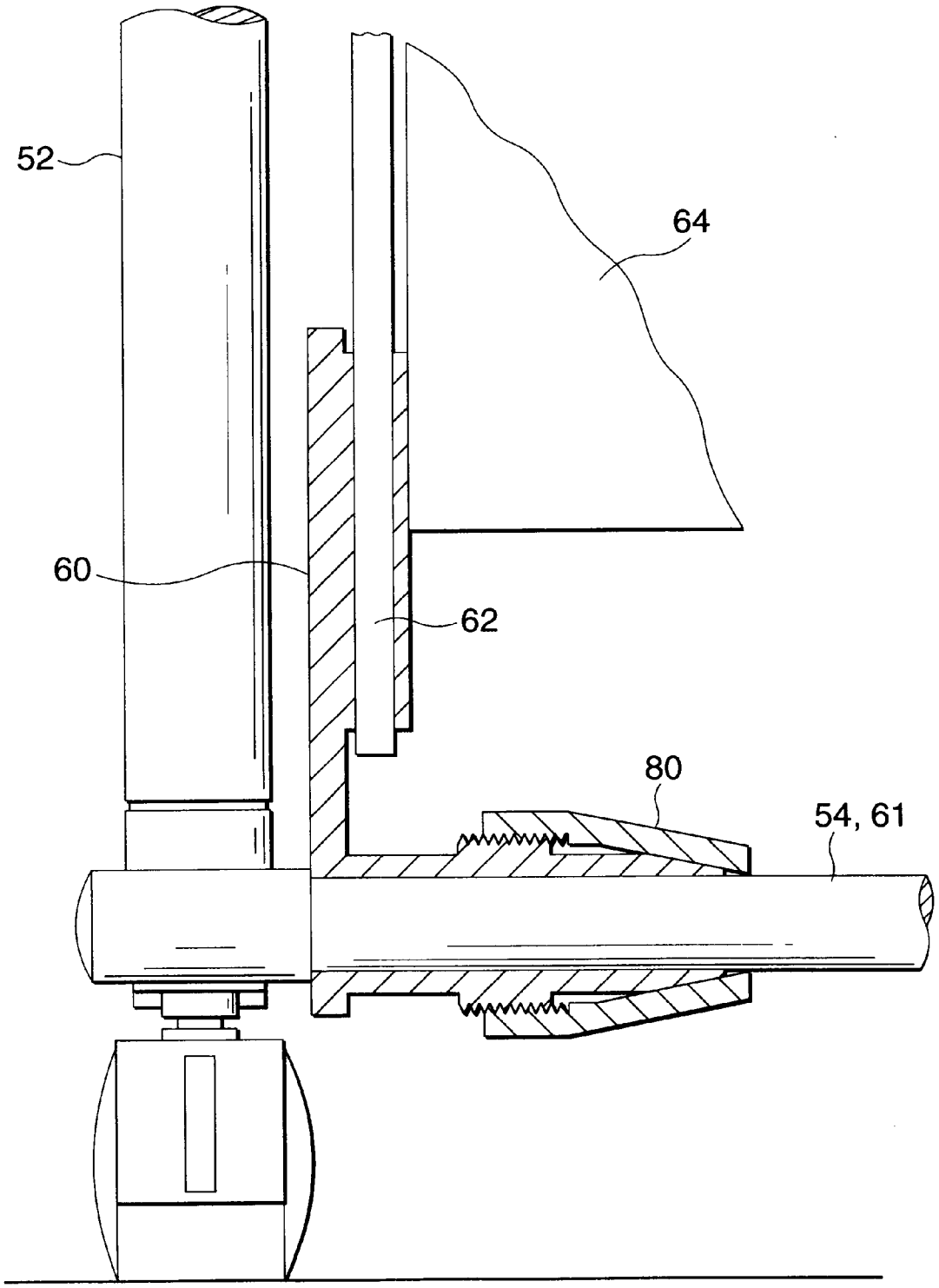
FIG. 8 is a front view of a rotatable force adjustment knob attached to a sectoral coupling member.

A pair of sectoral coupling members (e.g., synthetic resin members) 60 are rotatably attached to the fulcrum shaft 61. As is shown in FIG. 8, rotatable force adjustment knobs 80, which are also attached to the fulcrum shaft 61, engage the sectoral coupling members 60, and when they are screwed, the strength with which the sectoral coupling members 60 engage the fulcrum shaft 61 is varied and the force required to rotate the sectoral coupling members 60 (hereinafter referred to as the "rotatable force") is adjusted. In other words, when the engagement strength is increased, the force with which the sectoral coupling members 60 are secured to the fulcrum shaft 61 is increased, and accordingly, the rotatable force is also increased. And when the engagement strength is reduced, accordingly the rotatable force is reduced.

Since an appropriate rotatable force is set by using the adjustment knobs 80, the unexpected switching of the ejected paper receiving position can be prevented, and changing positions can be smoothly accomplished. When the ejected paper receiving unit 6 is shifted to the forward ejected paper receiving position or to the rear receiving position, the ejected paper receiving unit 6 can be fixed in the pertinent position by turning the rotatable force adjustment knobs 80 and increasing the rotatable force. Further, when the rotatable force adjustment knobs 80 are used to reduce the rotatable force, only a relatively small force is required to change the paper receiving position.

For the sectoral coupling members 60, a pair of front levers (e.g., metal rods) 62 are detachably provided in parallel in one of the directions in which the members 60 open out in the sector, and a pair of rear levers (e.g., metal rods) 63 are detachably provided in parallel in the other direction in which the members 60 open out in the sector. Thus, in side view, the front levers 62 and the rear levers 63 have a so-called L shaped structure.

Between the sectoral coupling members 60, a coupling rod (e.g., a metal rod) 65 for connecting the two is provided parallel to the fulcrum shaft 61. The sectoral coupling members 60 can be prevented from entering an unstable state by the coupling rod 65, and the members 60 can be stably rotated together. Accordingly, the entire ejected paper receiving unit 6 can be stably rotated.

Figure 6:
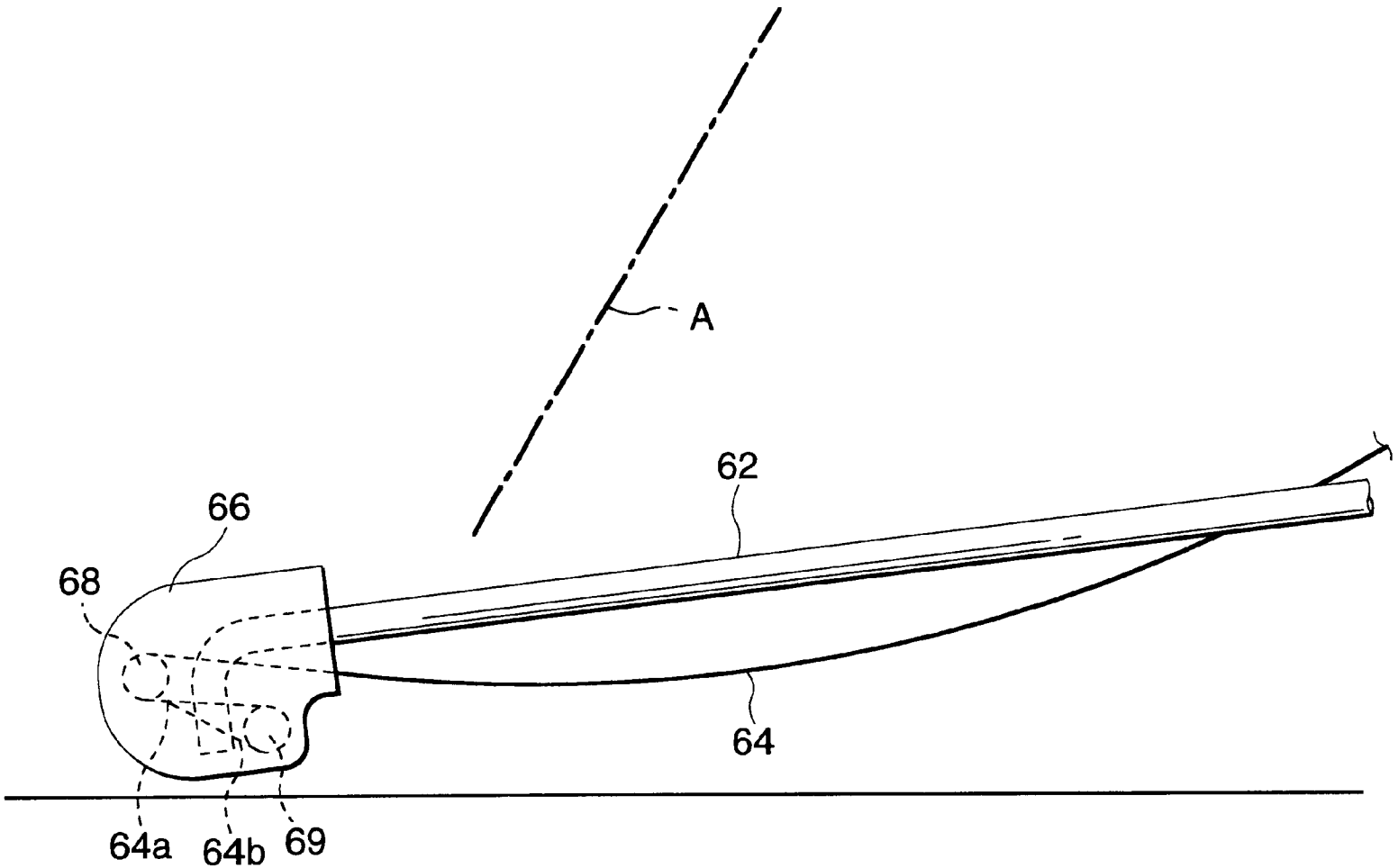
FIG. 6 is a detailed side view of the attachment structure for the front end of a sheet member.

Front coupling members (e.g., synthetic resin members) 66 are detachably provided for the individual distal ends of the front levers 62. Between the front coupling members 66, rods 68 and 69 are located substantially parallel to the fulcrum shaft 61 and the front end of the sheet member 64 is attached to them. FIG. 6 is a detailed diagram illustrating the structure of the attachment.

As is shown in FIG. 6, at the front receiving position, the rod 69 is closer to the fulcrum shaft 61 and is lower than the rod 68. To secure the sheet member 64 to the rods 68 and 69, the front end of the sheet member 64 is folded over and sewed together along a seam 64*a* to form a tubular holder 64*b*. The rod 69 is then inserted into the tubular holder 64*b* and the sheet member 64 is folded back over the rod 68 so it contacts approximately half the circumferential surface of the rod 68. When so positioned, the surface of the sheet member 64 is recessed toward the fulcrum shaft 61, and an interval is formed between the sheet member 64 and the rod 69.

With this arrangement, a recessed portion that is formed at the seam 64*a* is located on the reverse side of the route along which print sheets pass; the print sheets do not contact it. Thus, the route along which the print sheets pass is smoothly curved or substantially linear, so that there is nothing to impede their passage and they can slide smoothly across the sheet member 64.

The front receiving position is especially selected for accepting relatively long print sheets that are fed from the paper roll 21. Even when the leading end of such a long print sheet has contacted the sheet member 64, the printing unit 3 may still be printing the middle or the rear portion of the sheet, and the final length of the print sheet may exceed that of the sheet member 64 and extend downward to the floor. In this case, if the leading end of the print sheet does not smoothly pass across the front end of the sheet member 64, the rear portion of the sheet may be deflected or overlapped, so that a crease is formed in the print sheet, or so that portions of the printed face of the sheet may contact each other and be smudged. According to the arrangement of the embodiment, however, since print sheets can smoothly slide across the front end of the sheet member 64 and descend to the floor, this problem does not occur.

The lengths of the front levers 62 are so established that their front ends (and the front end of the sheet member 64) intersect a line A extended in the paper ejecting direction. Thus, either at the front receiving position or at the rear receiving position, when a print sheet is ejected it can be expediently received by the ejected paper receiving unit 6. For example, since gravity causes a relatively long print sheet to be ejected downward below the line A extended in the paper ejecting direction, it can be accepted with no problem, and further, a thick spreadsheet, such as posterboard, that is ejected substantially along the extended line A can be properly accepted.

Both at the front receiving position and the rear receiving position, the arrangement whereby the front ends of the front levers 62 (and the front end of the sheet member 64) intersect the line A extended in the paper ejecting direction can be implemented not only merely by adjusting the length of each front lever 62, but also by adjusting both this length and the rotation angle between the front receiving position and the rear receiving position.

Figure 7:
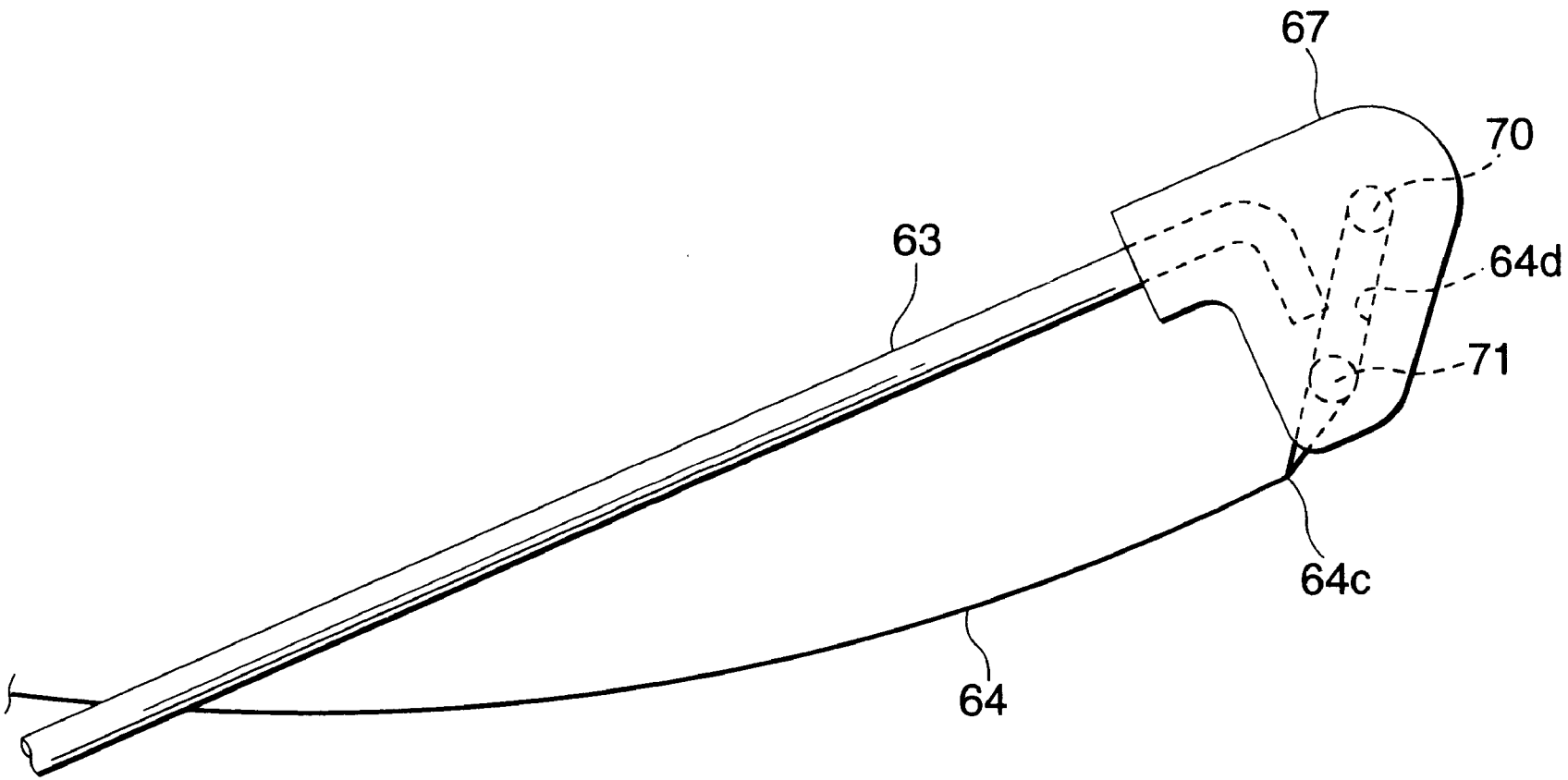
FIG. 7 is a detailed side view of the attachment structure for the rear end of the sheet member.

Rear coupling members (e.g., synthetic resin members) 67 are detachably provided at the distal ends of the rear levers 63. Between the rear coupling members 67, and substantially parallel to the fulcrum shaft 61, two rods 70 and 71 are attached to which the rear end of the sheet member 64 is secured. FIG. 7 is a detailed diagram showing the attachment structure.

As is shown in FIG. 7, at the rear receiving position, the rod 70 is located higher than the rod 71. To secure the sheet member 64 to the rods 70 and 71, the rear end of the sheet member 64 is folded over and sewed together at a seam 64*c* to form a tubular holder 64*d*. Then, to attach the sheet member 64, the rod 70 is inserted through the tubular holder 64*d* at the end and the rod 71 is inserted so it is the nearest to the seam 64*c*. With this arrangement, from the seam 64*c*, the rear end of the sheet member 64 forms an upright stop. Thus, when a print sheet is accepted at the rear receiving position, the print sheet is halted and is held inside the recessed area provided by the sheet member 64.

The print sheets received at the rear receiving position are generally relatively short, such as cut-sheets or sheets cut from a roll. Such a print sheet, after being ejected from the paper ejection unit 4, drops freely onto the sheet member 64 and slides down along its recessed shape. Thus, with a related structure, a print sheet, in consonance with the speed it attains, may overshoot the end of the sheet member 64 and drop on the floor behind the large printer 1. However, with the structure used in this embodiment, since the rear end of the sheet member 64 functions as a stop, the print sheet can be halted and expediently accepted in the sheet member 64.

Stoppers are provided on the leg bases 51 so that the ejected paper receiving unit 6 can be rotated only between the rear receiving position and the front receiving position, and rotation beyond these positions is prevented. These stops are, for example, protrusions (not shown) that contact the linear portions of the sectoral coupling members 60 at the rear and the front receiving positions, and thus limit rotational movement.

The front receiving position is determined so that the front ends of the front coupling members 66 contact the floor, or at only slight distance above the floor, and are lower than the rear ends of the rear levers 63. The rear receiving position is so determined that the front ends of the front levers 62 are higher than the rear ends of the rear levers 63, and that the angle θ formed by the sheet member 64 and the line A extended in the paper ejecting direction is an angle whereat the leading end of a print sheet contacts the sheet member 64 and is shifted down along the sheet member 64 and is not retained at the contact position.

The angle of the rear receiving position differs depending on the material of the sheet member and the strength of the print paper. According to an experiment wherein "Tetoron 1930," produced by Toray Industries, Inc., was employed as a sheet member, and thick and thin A3 sized glossy paper and a paper roll (regular paper) that was 24 inches wide were employed as print sheets, it was found that if the angle θ was equal to or less than 60 degrees, the print sheets were shifted down along the sheet member 64 by gravity, and were not retained at the contact position.

When the rear receiving position is so determined, the related problem can be avoided where when a print sheet is ejected and its leading edge contacts the ejected paper receiving unit, it is caught and held at the contact position, which results in the deterioration of print quality (e.g., it forms a transportation barrier, or the print sheet is bent and it contacts the print head). Furthermore, the bending of the leading end of a print sheet can be prevented.

Since the front receiving position can also be determined when the front coupling members 66 contact the floor, stops that hold the paper at the pertinent position may not be provided for the leg bases 51.

The operation performed by the large printer 1 will now be described.

The roll paper 21 in the paper feeding unit 2, or a cut-sheet positioned on the front inclined face 22*a*, is transported to the printing unit 3, is printed while being conveyed in the sub-scanning direction, and is ejected by the paper ejection unit 4.

Generally, before printing, the ejected paper receiving unit 6 is set by an operator at either the front receiving position or the rear receiving position. For this position setting, the operator need only perform a simple, short operation by manually rotating forward or backward either one of the front levers 62, the rear levers 63, the rods 68, 69, 70 or 71 of the ejected paper receiving unit 6.

When the ejected paper receiving unit 6 is placed in the front receiving position, the print sheet (e.g., long roll paper) that is ejected from the paper ejection unit 4 drops down below the extended line A until it reaches the sheet member 64, and then slides forward along the recessed shape of the sheet member 64. If the printing is completed and the print sheet is cut by the cutter before the leading end of the print sheet reaches the front end of the sheet member 64, the print sheet is accepted in the sheet member 64.

However, if the printing unit 3 continues the printing of the middle or the trailing portion of the print sheet even after the leading end of the print sheet has reached the front end of the sheet member 64, the leading end of the print sheet passes the front end of the sheet member 64 without being caught, and is moved to the floor. At this time, it is preferable that cloth be laid on the floor to keep the print sheet clean. Then, when the printing has been completed and the print sheet is cut by the cutter, one part of the sheet is held in the sheet member 64 while the other part is lying on the floor. Thereafter, the operator collects the print sheet.

When the ejected paper receiving unit 6 is set at the rear receiving position, the print sheet (e.g., a cut-sheet) that is ejected from the paper ejection unit 4 drops substantially along the line A extended in the paper ejecting direction, or slightly below the line A due to free dropping, and contacts the sheet member 64. Then, the print sheet is moved to the rear along the recessed shape of the sheet member 64, without being held at the contact position. When the print sheet reaches the rear end of the sheet member 64, the rear end functions as a stop, so that the print sheet is held in and does not extend outside the sheet member 64. Thereafter, the print sheet can be collected by the operator.

Since the front levers 62 are detachably provided for the sectoral coupling member 60 and the front coupling members 66, if, for example, an operator catches his foot in or is hit by the front levers 62, the front levers 62 will be disconnected, so that the operator is protected from being injured, and the ejected paper receiving unit 6 is prevented from being destroyed. The same thing applies for the rear levers 63.

As another example, a ratchet mechanism may be provided instead of the rotatable force adjustment knobs 80, in order to perform the rotation step by step. Further, the sheet member 64 may be made of a hard synthetic resin, such as plastic, instead of cloth, and may be recessed to constitute the ejected paper receiving unit.

According to the present invention, only a simple, short operation is required to rotate the ejected paper receiving unit to switch between the front receiving position and the rear receiving position.

What is claimed is:

1. An unit for receiving paper ejected from a large printer which is provided with a print feeding unit for feeding the print paper from upward, a printing unit for conveying the print paper while printing thereon, and a paper ejection unit for ejecting the print paper obliquely downward after completion of the printing, comprising:

a fulcrum shaft disposed below the paper ejection unit so as to extend in a widthwise direction of the print paper;

a receiver coupled with the fulcrum shaft so as to be pivotable about the fulcrum shaft, and including a receiving member for accepting the ejected print paper, which is provided between a front end and a rear end of the receiver so as to be recessed downward, the receiver having:

a first position for accepting the ejected print paper at a front side of the printer, in which the receiver is pivoted such that the front end thereof is positioned lower than the rear end thereof; and a second position for accepting the ejected print paper at a rear side of the printer, in which the receiver is pivoted such that the rear end thereof is positioned lower than the front end thereof, wherein a line extended straight from the paper ejection unit along a paper ejecting direction intersects the receiving member when the receiver is in the first position and the second position.

2. The paper receiving unit as set forth in claim 1, wherein the rear end of the receiver is shaped so as to stand upright when the receiver is in the second position.

3. The paper receiving unit as set forth in claim 1, wherein the receiving member is attached to the front end of the receiver creating an attached portion of said receiving member, and wherein said attached portion is located on a side of said receiving member different from a side of said receiving member on which the ejected print paper passes.

4. The paper receiving unit as set forth in claim 1, wherein the receiver includes:

a pair of pivotable members coupled with both ends of the fulcrum shaft;

a pair of first lever members extending forward from the pivotable members to constitute the front end of the receiver;

a pair of second lever members extending backward from the pivotable members to constitute the rear end of the receiver;

a first connecting shaft extending substantially parallel with the fulcrum shaft to connect the first lever members; and a second connecting shaft extending substantially parallel with the fulcrum shaft to connect the second lever members.

5. The paper receiving unit as set forth in claim 1, further comprising an adjuster for adjusting a force required to pivot the receiver.

6. The paper receiving unit as set forth in claim 1, further comprising a pair of legs located at respective ends of said fulcrum shaft which are capable of supporting a printer.

7. The paper receiving unit as set forth in claim 1, wherein the second position of the receiver is configured such that the line extended straight from the paper ejection unit along a paper ejecting direction intersects the receiving member at an angle allowing the print paper ejected to slide along the receiving member.

8. A large printer comprising:

a print feeding unit for feeding the print paper from upward;

a printing unit for conveying the print paper while printing thereon;

a paper ejection unit for ejecting the print paper obliquely downward after completion of the printing; and the paper receiving unit as set forth in any one of claims 1 to 7.

9. A paper receiving unit, comprising:

a fulcrum; and a receiver coupled to said fulcrum so as to be movable about a line passing through said fulcrum, said receiver comprising:

a front end;

a rear end, and a receiving member for accepting print paper, ejected from a paper ejection unit said receiving member being provided between said front end and said rear end of said receiver, the receiver also having:

a first position for accepting the ejected print paper at a first side of a printer, in which the receiver is pivoted such that the front end thereof is positioned lower than the rear end thereof; and a second position for accepting the ejected print paper at a second side of the printer, in which the receiver is pivoted such that the rear end thereof is positioned lower than the front end thereof, wherein a line extended straight from the paper ejection unit along a paper ejecting direction intersects said receiving member when said receiver is in said first position and said second position.

10. The paper receiving unit as set forth in claim 9, wherein the rear end of the receiver is shaped so as to stand upright when the receiver is in the second position.

11. The paper receiving unit as set forth in claim 9, wherein the receiver further includes:

a pair of movable members coupled with both ends of the fulcrum;

a pair of first lever members extending forward from the movable members to constitute the front end of the receiver;

a pair of second lever members extending backward from the movable members to constitute the rear end of the receiver;

a first connector extending substantially parallel with the fulcrum to connect the first lever members; and a second connector extending substantially parallel with the fulcrum to connect the second lever members.

12. The paper receiving unit as set forth in claim 9, further comprising an adjuster for adjusting a force required to move said receiver with respect to said line passing through said fulcrum.

13. The paper receiving unit as set forth in claim 9, wherein the second position of said receiver is configured such that said line extending straight along said paper ejection path intersects the receiving member at an angle allowing the ejected print paper to slide along the receiving member.

14. A printer; comprising:

a print feeding unit for feeding print paper;

a printing unit coupled to said print feeding unit for conveying the print paper while printing thereon;

a paper ejection unit coupled to said printing unit for ejecting the print paper along a path after completion of the printing; and a paper receiving unit coupled to at least one of said print feeding unit, said printing unit, and said paper ejection unit, wherein said paper receiving unit comprises:

a fulcrum; and a receiver coupled to said fulcrum so as to be movable about a line passing through said fulcrum, said receiver comprising:

a front end;

a rear end, and a receiving member for accepting said print paper, which is provided between said front end and said rear end of said receiver, the receiver also having:

a first position for accepting the print paper at a first side of the printer, in which the receiver is pivoted such that the front end thereof is positioned lower than the rear end thereof; and a second position for accepting the print paper at a second side of the printer, in which the receiver is pivoted such that the rear end thereof is positioned lower than the front end thereof, wherein a line extended straight from the paper ejection unit along a paper ejecting direction intersects said receiving member when said receiver is in said first position and said second position.

* * * * *